United States Patent [19]

Smith, Sr. et al.

[11] Patent Number: 4,578,828

[45] Date of Patent: Apr. 1, 1986

[54] OUTERGARMENT

[75] Inventors: James R. Smith, Sr.; Martha J. Smith, both of Memphis, Tenn.

[73] Assignee: Joe W. Johnson, Fulton, Ky.

[21] Appl. No.: 672,998

[22] Filed: Nov. 19, 1984

[51] Int. Cl.[4] ..... E03D 5/04; A41B 9/04

[52] U.S. Cl. ..... 2/234; 2/408

[58] Field of Search ..... 2/2, 408, 234

[56] References Cited

U.S. PATENT DOCUMENTS

| | | | |
|---|---|---|---|
| 2,166,088 | 7/1939 | Boetcker | 2/234 |
| 2,336,554 | 12/1943 | Lippmann | 2/234 |
| 4,561,121 | 12/1985 | Ehring et al. | 2/227 |

*Primary Examiner*—Doris L. Troutman

*Attorney, Agent, or Firm*—Harry B. O'Donnell, III

[57] ABSTRACT

A novel and useful pants-type outergarment having a crotch opening and a padded fly attached to the interior of the outergarment on one side to the crotch opening seam line, beginning at a front placket of the outergarment and extending to the back waistband. First fastener means are provided on one side of the padded fly to cooperate with and releasably engage second fastener means provided on the inner thigh seam line adjacent to the crotch opening so that, when the two fastener means are engaged with each other, the padded fly cannot roll up while the garment is being worn, and third fastener means are provided to selectively close together and open apart the opposite sides of the crotch opening.

14 Claims, 5 Drawing Figures

OUTERGARMENT

BACKGROUND OF THE INVENTION

The present invention relates to outerwear and, more particularly, to pants-type outerwear having a torso section, with leg sections extending therefrom, wherein the crotch sections can be easily separated adjacent to the crotch line for relief of bodily functions.

Generally, pants-type garments such as slacks, shorts, jumpsuits, etc. are designed so that the wearer must partially or completely disrobe in order to relieve bodily functions. Obviously such arrangements are quite inconvenient, particularly when in use away from home, as in a public restroom or in the out-of-doors.

Outergarments of the type contemplated by the present invention are of particular use to female wearers, since women are currently taking advantage of more and more outdoor activities in which pants-type garments are worn, and have found it increasingly disadvantageous to be required to disrobe in the open. Likewise, women in the military frequently experience the aforenoted problems when in the field.

No prior-art arrangement is known which provides means for relieving bodily functions without requiring at least partial disrobing by a female wearer of a pants-type outergarment. Nor is any prior-art outergarment known that has an opening along the crotch line between the rear and the front of the outergarment which provides access to a second or inner fly located at the front of the outergarment. Nor is it known in the prior-art to provide an outergarment with an inverted fly so that no additional undergarment is required for protection of the wearer's crotch.

In one prior-art form, such as described in U.S. Pat. No. 3,425,063, there is provided an outergarment having a zippered crotch with an undergarment attached to that old outergarment along the inside leg seams, wherein the undergarment crotch opening is in registry with the zippered crotch of the outergarment. However, this just-noted prior-art patent fails to show, teach or suggest the use of a single garment as provided by the improved outergarment of present invention which, thus, facilitates its use and reduces its cost to fabrication.

Other prior-art arrangements for somewhat similar purposes are shown in U.S. Pat. Nos. 2,264,958; 2,689,958; 2,812,516 and 2,839,057.

However, none of the prior-art patents shown, describe nor teach the novel and useful features of the outergarment that is provided in accordance with the present invention and which is described in detail hereinafter.

SUMMARY OF THE INVENTION

The present invention provides a new, useful and inexpensive pants-type outergarment that is particularly useful for female wearers and wherein the novel outergarment has a crotch opening to facilitate the performance of bodily functions.

Outergarments within the scope of the present invention provide the feature of an invisible fly aligned over an opening in the crotch of the garment. An inverted padded fly can be provided in the crotch opening seam and can be obtained by sewing an invisible zipper along the crotch opening seam line so that it is only necessary to unzip the outergarment crotch area and removal of clothing is not required for urination or defecation by the wearer. When an invisible zipper is utilized, as provided by the present invention, there is no outward indication that the novel outergarment is any different in construction from a regular outergarment utilizing a conventional seam line.

In further accordance with the present invention an outergarment can be provided an internal padded fly to protect its wearer's crotch area from irritation by the aforenoted invisible zipper.

The present invention further provides first fastener means on the inverted fly that are releasably engageable with second fastener means provided on the inner thigh seam line to prevent the inverted padded fly from rolling or twisting while the novel outergarment of the present invention is being worn.

More particularly, the present invention provides a novel pants-type outgarment having a crotch opening and an inverted padded fly attached on one side to the crotch opening seam line, beginning at a front placket of the outergarment and extending to the back waistband. First fastener means are provided on one side of the inverted fly to cooperate with and releasably engage second fastener means provided on the inner thigh seam line adjacent to the crotch opening so that, when the two fastener means are engaged with each other, the inverted padded fly cannot roll while the outergarment is being worn, and third fastener means are provided to selectively fasten the crotch opening closed between the legs and allow separation between the leg portions of the outergarment.

Arrangements within the scope of the present invention will occur to those skilled in the art upon reading the additional disclosure set forth hereinafter, which is directed toward a presently preferred embodiment of the novel outergarment provided within the scope of the present invention and is presented in the drawing included herewith for purpose of example but not by way of limitation.

BRIEF DESCRIPTION OF THE DRAWINGS

The present invention is illustrated in the accompanying drawings, wherein.

DETAILED DESCRIPTION

Figure 1:
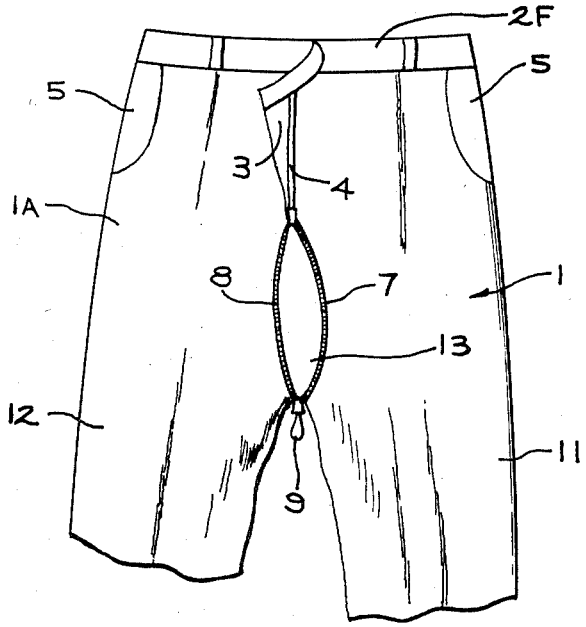
FIG. 1 is a front elevational view illustrating one presently preferred form of the novel outergarment that is provided in accordance with the present invention for wear by a female person and with the crotch opening shown partially opened.
Figure 2:
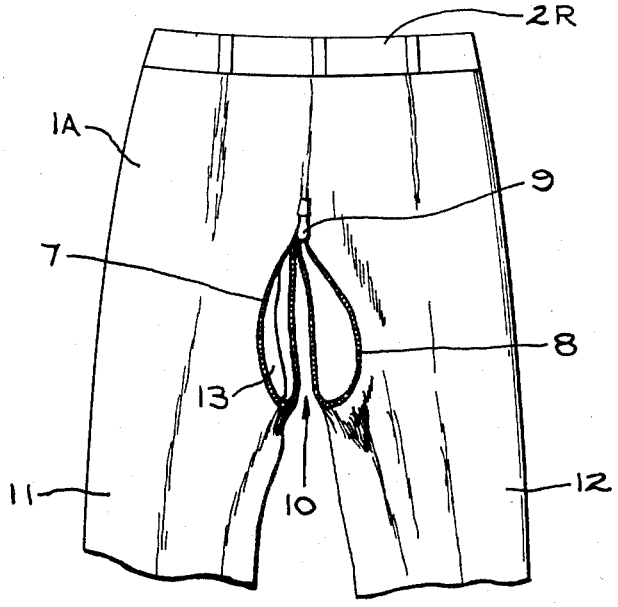
FIG. 2 is a rear elevational view of the outergarment shown in FIG. 1 with the crotch opening shown fully opened.

Turning now to the drawings and, more particularly, to FIGS. 1 and 2 thereof, there is shown a presently preferred form of an outergarment 1 that is provided in accordance with the present invention. In the illustrated embodiment, the outergarment 1 is a pants-type garment including a torso segment 1A that is topped by a waistband 2F and 2R, which encircles the waist of a female wearer (not shown), and has a conventional front placket 3 for covering its conventional front fly opening that is selectively opened and closed by a conventional zipper 4 that extends vertically downward from the front of the waistband 2F to the top of a novel crotch opening 10 that is provided in particular accordance with the present invention. Leg-receiving portions 11 and 12 extend downwardly from the torso segment 1A, which is also provided with pockets 5, as illustrated.

As further shown in drawing FIGS. 1–2 and 4–5, the novel crotch opening 10 is centrally located between the two leg-receiving portions 11 and 12 and extends between the front and rear of the outergarment 1 along its crotch seam from the bottom of the front placket 3 to the bottom of the rear waistband 2R to provide, when opened, separation between the leg-receiving portions 11 and 12 of the outergarment 1.

As still further shown in the drawings, fastener means, in the form of zipper segments 7 and 8 of a so-called invisible zipper and their cooperative zipper pull 9, which is located on the exterior of the outergarment 1, are provided for selectively closing (FIG. 4) and opening (FIGS. 1, 2 and 5) the novel crotch opening 10. It should be understood, of course, that, when fully zipped, the zipper pull 9 is preferably concealed from view by the overlying front placket 3.

And, as also illustrated in the drawing FIGURES, the novel outergarment 1 of the present invention is preferably provided with an internal or inverted padded fly or flap 13 that is hinged to the interior of the outergarment 1 along a thigh seam located adjacent to one (the left 7 as shown in the drawings) of the crotch opening zipper segments 7 and 8 to be unfolded over the interior of those zipper segments 7 and 8 (FIGS. 1 and 3) and, thus, protect a wearer's crotch area from possible abrasion by those zipper segments 7 and 8 when they are so covered by the padded fly or flap and to be folded away from the crotch opening 10 (FIGS. 2, 4 and 5) when the wearer acts to urinate and/or deficate via the unzipped crotch opening 10.

Figure 3:
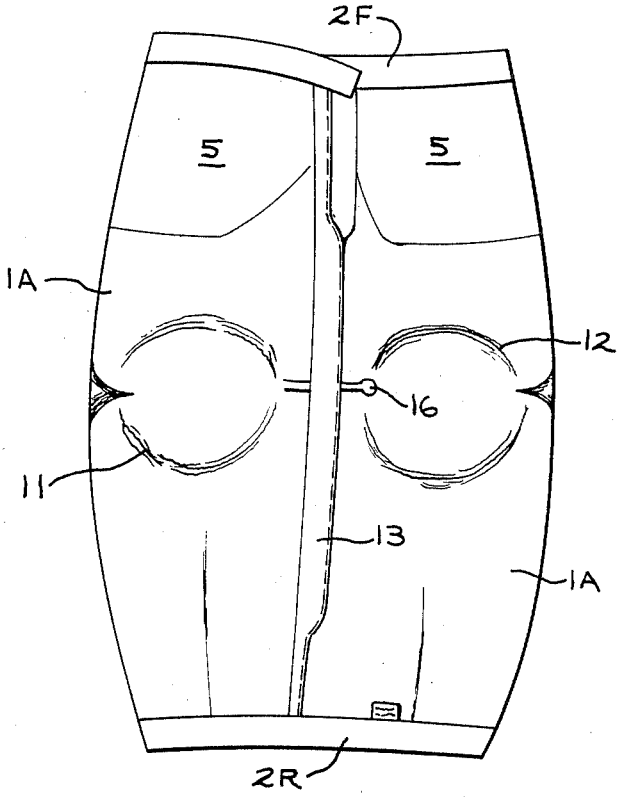
FIG. 3 is an unfolded, cut-apart, inside, top view of the outergarment shown in FIG. 2, illustrating in particular the construction of its inverted padded fly, which is provided in accordance with the present invention, in its unfolded position covering the crotch opening.
Figure 4:
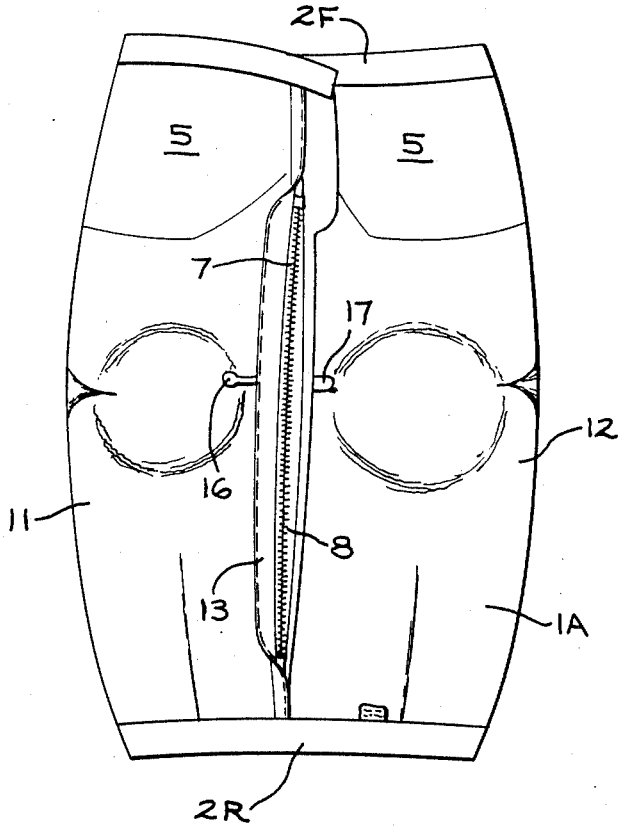
FIG. 4 is a view similar to FIG. 3, but showing the inverted padded fly in its folded position to thus reveal the location and construction of the crotch opening fastener means which comprise a closed zipper.
Figure 5:
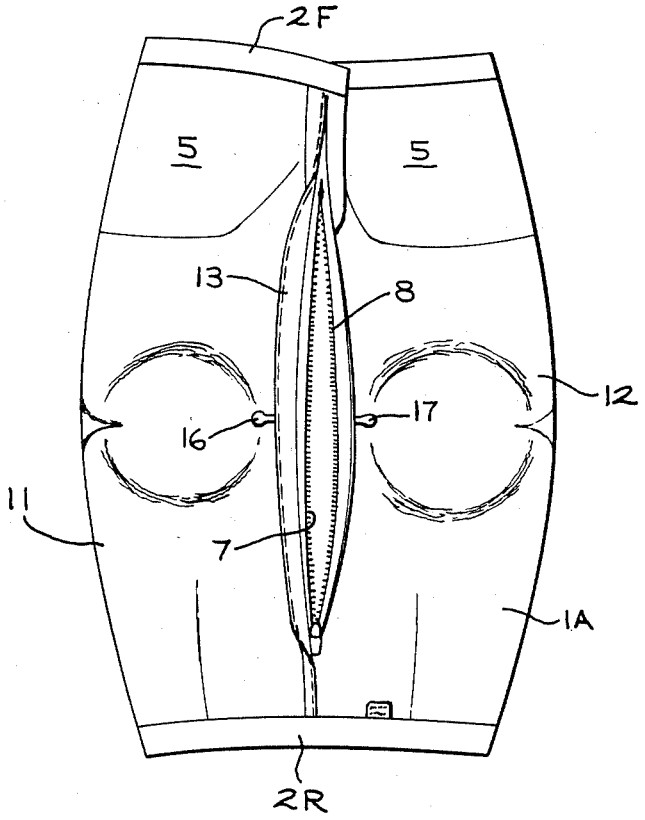
FIG. 5 is a view similar to FIG. 4, but illustrating the zipper fastener means for the crotch opening unzipped.

The crotch opening padded fly or flap 13 can be comprised of plural layers of a washable or dry cleanable material and, in further accordance with the present invention, as best shown in drawing FIGS. 3–5, additional fastener means 16 and 17 are provided for releasably fastening the crotch opening padded fly or flap 13 in its unfolded position (FIGS. 1 and 3) covering the interior of the crotch opening zipper segments 7 and 8 and deter the crotch opening padded fly or flap 13 from undesirable rolling away towards its folded position (FIGS. 2, 4 and 5).

As best shown in drawing FIGS. 3–5, these just-noted crotch fly or flap fastener means 16 and 17 can include one fastener means 16 that is provided on the distal end of the crotch fly or flap 13 for releasable engagement with another complementary fastener means 17 that is provided on the interior of the outergarment 1 on the side of the crotch opening opposite that to which the padded fly or flap 13 is hinged and, desirably, as shown, between the other zipper segment 8 and thigh seam line.

Preferably, these crotch fly or flap fastener means 16 and 17 consist of Velcro or Velcro-type fasteners which are easy to open and close and provide an adjustable fit to the crotch area of the wearer of the novel outergarment 1 that is provided in accordance with the present invention. Velcro is a flexible material capable of multiple adjustments by virtue of hooks and loops locking elements provided on the engageable or fastenable portions. Velcro fastener means consists of a first surface that is composed of nylon "loops" or pile material engageable with another surface which is composed of Velcro nylon "hooks".

In the embodiment of the novel outergarment 1 of the present invention illustrated in the drawings, the "hook" fastener elements are provided on the lower surface of the first fastener means tab 16, while the "eye" fastener elements are provided on the upper surface of the complementary fastener means 17.

As is apparent, the aforedescribed fastener means 16 and 17 are releasably engageable with one another so that a wearer of the novel outergarment 1 can selectively uncover and cover the interior of the crotch opening zipper segments 7 and 8 by selectively peeling apart (FIG. 4) and pressing together (FIG. 3) those fastener means 16 and 17. And, when it is desired to fully open or close the crotch opening 10, this can be achieved by operating the zipper pull 9 to respectively unzip or zip together the zipper segments 7 and 8.

It should be further apparent that while there has been described what is currently considered to be a presently preferred form of the present invention in accordance with the Patent Statutes, changes may be made in the disclosed outergarment without departing from the true spirit and scope of this invention. It is, therefore, intended that the appended claims shall cover such modifications and applications that may not depart from the true spirit and scope of the present invention. For example, fasteners other than Velcro can be employed for the fastener means 16 and 17 and additional fasteners could be provided so that the padded fly or flap 13 could be made totally removably from the outergarment 1.

What is claimed is:

1. A pants-type outergarment comprising:

(a) a waistband connected to a torso section having a front placket;

(b) leg receiving portions depending from said torso section with a crotch opening therebetween defined by opposite first and second crotch opening sides and extending from said front placket to the back of said waistband;

(c) padded fly means mountable within the interior of said outergarment for selectively covering and uncovering said crotch opening; and (d) fastener means for releasable fastening at least a portion of said padded fly means to the interior of said, outer garment in a position covering said crotch opening.

2. The invention of claim 1, wherein said additional padded fly means is hinged to the interior of said outergarment adjacent to said first side of said crotch opening to be selectively unfolded across and folded away from said crotch opening to thus selectively cover and uncover said crotch opening.

3. The invention of claim 2, wherein said fastener means comprise first fastener means provided on said padded fly means for releasable engagement with second fastener means provided adjacent to said second side of said crotch opening for releasably securing said padded fly in a position unfolded across said crotch opening.

4. The invention of claim 3, further including additional fastener means for selectively closing together and opening apart said first and second crotch opening sides.

5. The invention of claim 4, wherein said first and second fastener means comprise VELCRO fastener means.

6. The invention of claim 5, wherein said additional fastener means comprises zipper means.

7. The invention of claim 1, wherein said fastener means comprise VELCRO fastener means.

8. The invention of claim 2, wherein said fastener means comprise VELCRO fastener means.

9. The invention of claim 3, wherein said first and second fastener means comprise VELCRO fastener means.

10. The invention of claim 4, wherein said additional fastener means comprise zipper means.

11. The invention of claim 1, further including additional fastener means for selectively closing together and opening apart said first and second crotch opening sides.

12. The invention of claim 11, wherein said fastener means comprise zipper means.

13. The invention of claim 2, further including additional fastener means for selectively closing together and opening apart said first and second crotch opening sides.

14. The invention of claim 13, wherein said additional fastener means comprise zipper means.

* * * * *

UNITED STATES PATENT AND TRADEMARK OFFICE

CERTIFICATE OF CORRECTION

PATENT NO. : 4,578,828

DATED : April 1, 1986

INVENTOR(S) : James R. Smith, Sr., et al.

It is certified that error appears in the above-identified patent and that said Letters Patent is hereby corrected as shown below:

Column 4, line 54, after "said" (first occurr.) delete -- , --.

Column 4, line 55, after "said", delete -- additional --.

Signed and Sealed this

*Twenty-sixth* Day of *August 1986*

[SEAL]

*Attest:*

DONALD J. QUIGG

*Attesting Officer*

*Commissioner of Patents and Trademarks*